United States Patent [19]

Dixon

[11] Patent Number: 4,517,572

[45] Date of Patent: May 14, 1985

[54] SYSTEM FOR REDUCING BLOCKING IN AN ANTENNA SWITCHING MATRIX

[75] Inventor: Thomas Dixon, Seabrook, Md.

[73] Assignee: Amstar Corporation, New York, N.Y.

[21] Appl. No.: 402,620

[22] Filed: Jul. 28, 1982

[51] Int. Cl.[3] ..... H01Q 21/30; H01P 1/10

[52] U.S. Cl. ..... 343/876; 333/101

[58] Field of Search ..... 343/876, 853, 858; 333/101

[56] References Cited

U.S. PATENT DOCUMENTS 3,208,071 9/1965 Potthoff ..... 343/876

4,165,497 8/1979 Irons ..... 333/101

FOREIGN PATENT DOCUMENTS 354126 6/1961 Switzerland ..... 343/853

*Primary Examiner*—Eli Lieberman

*Attorney, Agent, or Firm*—Oblon, Fisher, Spivak, McClelland & Maier

[57] ABSTRACT

An add-on system as disclosed for use with an existing multilevel antennae switching matrix of the type having a plurality of input ports, each supplied by a respective input signal source with at least one unused input port being available and a plurality of output ports are connected to receivers. The add-on system uses a plurality of switching devices which are each selectively operable to couple each of the input signal sources to a different one of the unused input ports. This provides that when an attempt to effect an interconnection between a desired one of the input ports and a desired output port is blocked then the input signal source which supplies the desired input port associated with an attempt connection is coupled to any one of the unused input ports for facilitating the connection at that port to the desired output port.

2 Claims, 2 Drawing Figures

SYSTEM FOR REDUCING BLOCKING IN AN ANTENNA SWITCHING MATRIX

BACKGROUND OF THE INVENTION

1. Field of the Invention

The present invention relates to antenna switching matrices, and more particularly to an add-on system for an existing antenna switching matrix which improves the deblocking performance.

2. Description of the Prior Art

The use of computer controlled digital switching systems in order to control the switching of signals from multiple antenna sources to a plurality of receiver positions is well known in the art. In quantative terms, such switching matrices are often required to selectively interconnect up to 200 input antenna sources with up to 500–1000 output receiver positions. While such switching matrices are preferably designed to be non-blocking, i.e. any input port to output port connection can be made regardless of the state of the matrix, economic considerations many times militate against this optimum design. For example, considering the foregoing example of matricing 200 input antenna sources with 500 receiver positions, a non-blocking rectangular switch matrix may be designed by connecting each input antenna source to 500 different cross points or on-off switches. As a result, 100,000 cross points or switches are required to implement the design with each switch costing in the neighborhood of $300 so that the system cost would approach 30 million dollars. Various types of multi-level switching matrices have been designed in the past to reduce this cost by minimizing the number of cross points used. Such multi-level switching matrices typically comprise an input level or tier and submatrices have a plurality of input ports for connection to the antenna sources, an output level or tier of submatrices having a plurality of output ports supplying the reciever position and a middle level or tier of submatrices interconnecting the input and output levels, the state or switching configuration of the matrix typically being controlled by digital computer operated in response to user input data. While multi-level switching matrices reduce system cost by reducing the number of cross points, which is generally accomplished by minimizing the number of middle level submatrices, there is sometimes required an economic trade-off and as a result the matrix is not completely non-blocking such that a condition may arise where a desired input port to output port cannot be made.

This blocking problem which is somewhat analagous to telephone switching arrangements, has been addressed in the basic design of prior art telecommunications systems. The addressing of this overflow problem in the telephone switching art usually involves a system which is designed from the ground up in order to take advantage of a rearranging system of inputs or outputs in order to provide a desired communication link between an incoming call and its desired telephone. A particular indication of this type of switching is shown by the U.S. Pat. No. 3,566,041, to Ekberg, which sets up a two-stage cross bar switching network which provides overflow links between the cross bar switches of the first stage of a network. This is accomplished by providing a multiple of connections which may be used when blocking is encountered within the network. That is, when each of a first-stage switch has its overflow multiples directly connected to overflow multiples of a plurality of other first-stage switches then when blocking is encountered in the first stage the connection is set up to an overflow path by connecting the "calling" inlet to one of the overflow switches through the use of the cross bar operation. This results in the overflow multiple of a different first-stage switch, to which the first connected overflow multiple is connected, to itself be connected to a suitable cross bar operation to a second coordinate multiple with access to a wanted outlet. This type of structure requires the setting aside of multiples in a plurality of stages, which of course provides an excess cost in the existance of those multiples and which must be designed into the system at its conception and building stage.

Other solutions to the overflow problem involve the setting aside of separate complete channels. Examples of these types of systems include the U.S. Pat. No. 4,146,749 to Pepping et al which discloses a switching system having a dedicated group of access ports for completing connections and a single spare block network provided with a separate programmable identity capable of functioning in place of any of the primary blocks. The patent to Marchetti et al, U.S. Pat. No. 4,160,130 shows a plurality of switch units which each have included therewith a bypass unit for permitting a selected group or class of subscribers to make use of the system following use of certain malfunctions or failures.

Another type of input rearranging type of device in the telecommunications art is shown by the Wang reference, U.S. Pat. No. 4,038,638, which discloses an input-mixed rearrangable network which addresses the problem of a blocked multi-state switching network which occurs because a network happens to be interconnected in a manner that prevents a affecting the desired interconnection. The switching network can perform the function of changing around the inputs to provide a proper connection. Yet another system which can be used to overcome overflow in the telecommuncations art is the loop-around lines which are used if an idle network connection cannot be found through the normally equiped lines as is shown by the patent to Giesken, U.S. Pat. No. 3,816,668. Likewise, the patent to Morino, U.S. Pat. No. 3,823,270 discloses a trunking arrangement having a separate path to a support primary section if a direct path is not available in order to find an available path from a primary to an available secondary.

Each of these prior art devices fail to solve the problem with regard to existing antenna switching matrices because they are either designed from the ground up, involve extensive and costly modifications or most importantly are designed for telecommunications systems which are distinctly different and face different problems than the antenna matrix switching systems. That is, the plurality of antennas must be capable of switching to one or a plurality of the receivers at the output. On the other hand, the type of telecommunications switching arrangements illustrated by the above prior art deals with switching one incoming line to a single output line.

In summation then, the prior art fails to disclose a simple system which can convert an antenna matrix switching system already in existance to a type of system which alleviates the blocking or overflow problem. While many systems have shown procedures for overcoming overflow problems in telecommunications, these systems would not inherently perform the same function in the antenna switching systems and, most importantly, all of these devices are either part of a system designed from the ground up or they involve costly additions of spare and separate complete channels.

The present invention overcomes the problems of the prior art with regard to already existing antenna switching matrix systems through the use of an inexpensive add-on switching system which substantially alleviates the deblocking or overflow problems.

SUMMARY OF THE INVENTION

Accordingly, it is a primary object of the present invention to provide an existing antennae switching matrix with reduced or eliminated blocking at a minimum cost.

This and other useful objects are achieved by providing an external deblocking switch matrix operating in association with a conventional multilevel switching matrix. More particularly, a conventional multilevel antennae switching matrix is provided and includes a plurality of input ports each connected to a respective input signal source, at least one unused input port and a plurality of output ports. The deblocking switch matrix comprises at least one switching device which is selectively operable for coupling each of the input signal sources to an unused input port of the multilevel matrix. A control device, preferably the digital computer used to direct the desired interconnections of the multilevel matrix, is responsive to the detection of a blocked condition characterizing an attempted connection between a desired input port and a desired output port for operating the switching device for coupling the input signal source supplying the desired input port to the unused input port for facilitating the connection thereof to the desired output port.

BRIEF DESCRIPTION OF THE DRAWINGS

A more complete appreciation of the invention and many of the attendent advantages thereof will be readily obtained as the same becomes better understood by reference to the following detailed description when considered in connection with the accompanying drawings, wherein.

DESCRIPTION OF THE PREFERRED EMBODIMENTS

Figure 1:
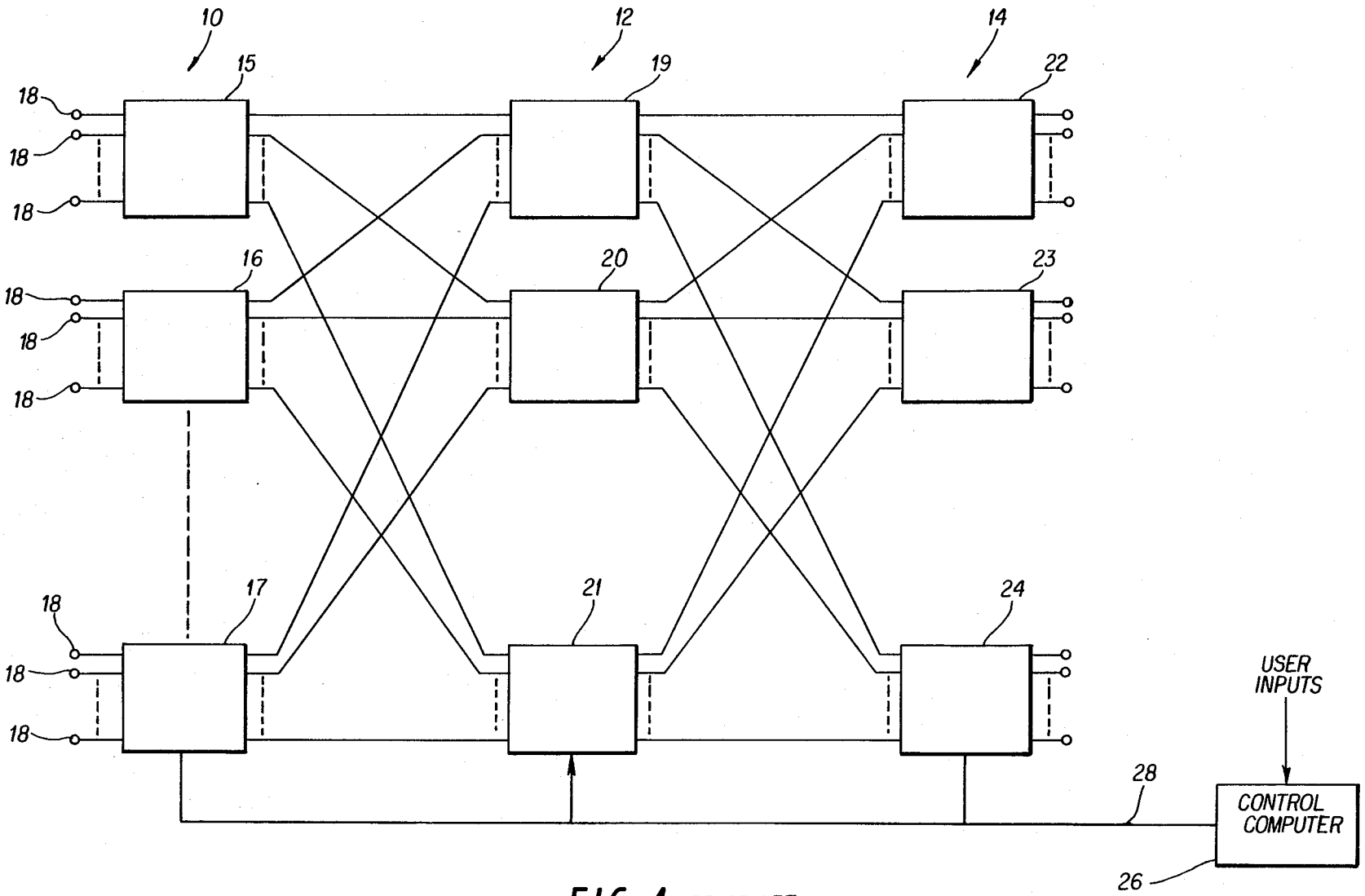
FIG. 1 PRIOR ART
FIG. 1 is a block diagram of a tyical prior art multilevel switching matrix.

Referring now to the drawings, and more particularly to FIG. 1 thereof, there is illustrated a typical prior art multilevel switching matrix which includes three levels or switching stages, an input stage 10, a middle stage 12 and an output stage 14. Input stage 10 includes a plurality of identical submatrices 15–17 each providing a plurality of input ports 18, each input port 18 being adapted for connection to a separate input signal source 1,2 . . . N such as an antenna. Each of the submatrices 15–17, as well as the remaining submatrices of the multilevel matrix, may comprise, for example, a switching matrix of the general type disclosed in U.S. Pat. No. 4,165,497. The number of input stage submatrices 15–17 actually used in the system is determined by the number of individual input signal sources which are present. Thus, since each input stage submatrix 15–17 includes the same number of input ports, e.g. twelve, enough submatrices are used to provide a sufficient number of input ports 18 to accomodate all of the input signal sources with several ports typically being left unused, the unused input ports being identified by reference numerals 18*a*. For example, if 200 input signal sources are present, seventeen input stage submatrices each having twelve input ports are required, four of the input ports being unused.

Each input stage submatrix 15–17 includes a plurality of output lines connected to the input ports of a plurality of middle stage submatrices 19–21 such that each middle stage submatrix 19–21 has one input port connected to output line of each input stage submatrix 15–17. In a similar manner, each middle stage submatrix 19–21 also includes a plurality of output lines connected to the input ports of a plurality of output stage submatrices 22–24 such that each output stage submatrix 22–24 has one input port connected to one output line of each middle stage submatrix 19–21. Each output port 25 of the output stage submatrices 22–24 is adapted for connection to a separate user input such as an individual receiver position. The required number of output stage submatrices 22–24 is determined by the number of system users, one output port 25 being required for each such system user. After the required number of input stage submatrices 15–17 and output stage submatrices 22–24 have been determined, the number of middle stage submatrices 19–21 is established by empirically adding submatrices to the middle level 12 until the blocking rate of the system reaches an acceptable level. Economic versus performance tradeoffs are made in establishing this number since, the inclusion of an excessive number of middle stage submatrices 19–21, although improving the deblocking performance of the matrix, results in excessive system costs while the provision of an insufficient number of middle stage submatrices results in an unacceptable deblocking rate. Therefore, a compromise must be achieved between these two competing factors such that an affordable system is provided with a blocking rate, while not being characterized by an optimum zero level, approaches what is considered to be an acceptable level.

Operation of the multilevel switching matrix shown in FIG. 1 is normally controlled by a digital computer 26 in response to user input data. Computer 26 includes an output bus 28 which controls the state of each of the submatrices 15–17, 19–21 and 22–24 for selectively interconnecting individual input ports 18, each of which is supplied by a separate input signal source, to individual output ports 25 in response to appropriate user input commands. In other words, in response to an appropriate user command, computer 26 is operative for setting the states of submatrices 15–17, 19–21 and 22–24 such that a signal path is effected between the user's output port 25 and an input port 18 connected to a desired input signal source. As explained above, while computer 26 will always attempt to satisfy a desired input port 18 to the output port 25 interconnection thus will not always be possible in which case the desired interconnection is referred to as being blocked. For example, a sequence of previously requested interconnections may result in a composite matrix state wherein an additional desired input port 18 to output port 25 connection cannot be made.

Figure 2:
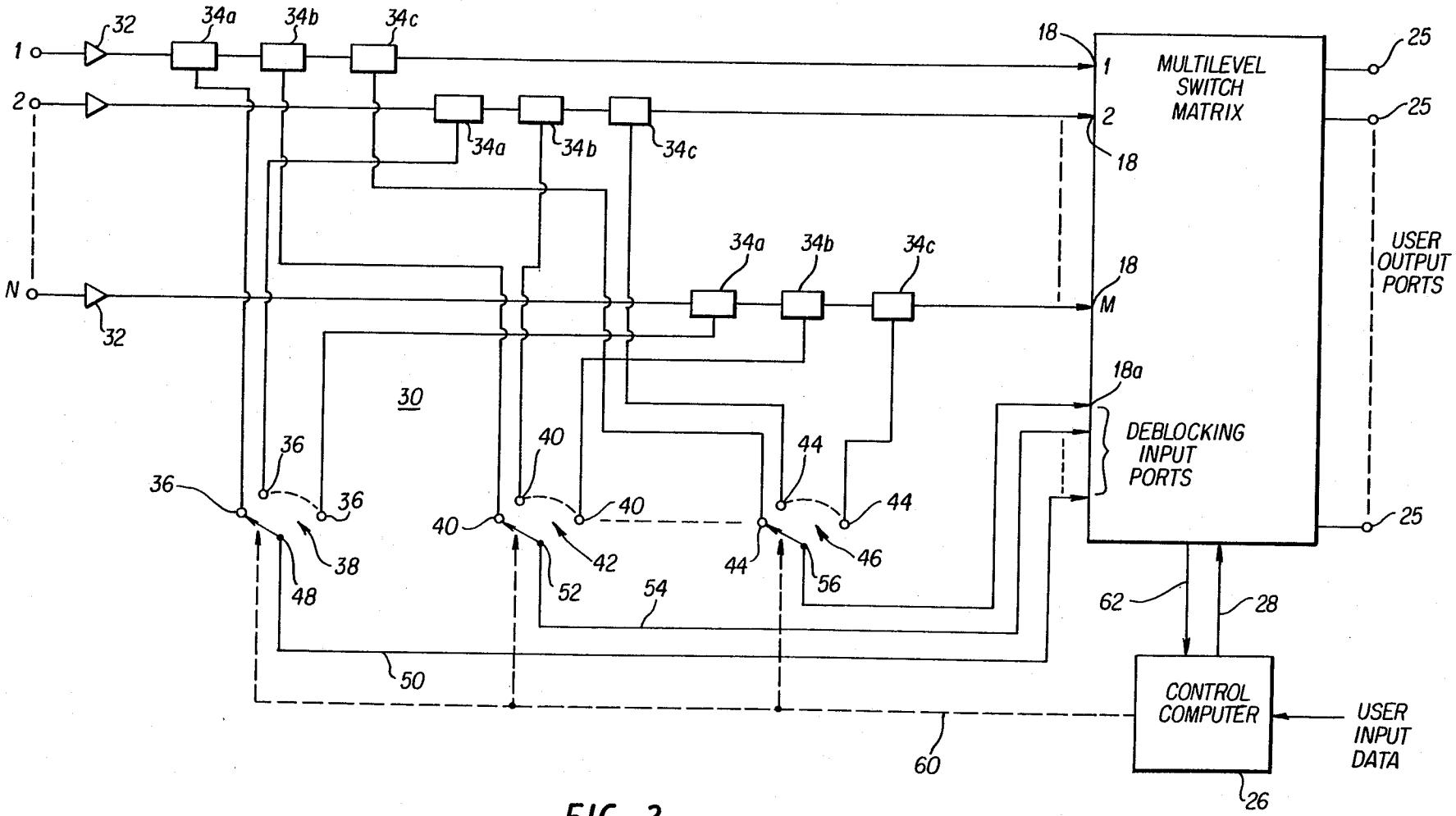
FIG. 2 is a block diagram of a deblocking switch matrix according to the present invention, the deblocking switch matrix interfacing with the multilevel switching matrix of FIG. 1.

Referring to FIG. 2, the foregoing blocking problem is minimized in accordance with the present invention by interposing a deblocking switch matrix 30 between the input signal sources and the input ports 18 of the multilevel switching matrix. As will be explained in detail hereinafter, deblocking switch matrix 30 is operable in response to control computer 26 for coupling an input signal source associated with a desired but blocked input port 18 to output port 25 connected to an unused or deblocking input port 18*a* of the multilevel switch matrix. Computer 26 is then operative for effecting a composite state of the multilevel matrix for interconnecting the deblocking input port 18*a* to the desired output port 25 such that the desired input signal source is coupled thereof. In this manner, deblocking switch matrix 30 facilitates the establishment of an auxilliary signal path from a desired input signal source to a desired output port 25 when an initially attempted signal path is blocked. And, most advantageously, it has been found that deblocking switch matrix 30 introduces fewer crosspoints to achieve a given improvement in the overall system blocking rate than would be introduced by adding more middle stage submatrices 19–21 to achieve an equivalent blocking rate improvement.

With further reference to FIG. 2, interposed between each input signal source 1, 2 . . . N and its associated input port 18 of the multilevel switch matrix is an amplifier 32 and a series of directional couplers 34*a*, 34*b* and 34*c*. The first directional coupler 34*a* in each of the series is supplied by its associated input signal source through amplifier 32 with the input ports of the remaining couplers 34*b*, 34*c* being supplied by the direct output port of the immediately preceding coupler. The coupled output ports of the directional couplers 34*a* are connected to respective input terminals 36 of a first multiposition deblocking switch 38, the coupled output ports of directional couplers 34*b* to respective input terminals 40 of a second multiposition deblocking switch 42 and the coupled output ports of directional couplers 34*c* to respective input terminals 44 of a third multiposition deblocking switch 46. The output terminal 48 of the switch 38 is connected by a conductor 50 to a first unused or deblocking input port 18*a*, the output terminal 52 of switch 42 being connected by a conductor 54 to a second unused or deblocking input port 18*a* and the output terminal 56 of switch 46 being connected by a conductor 58 to a third unused or deblocking input port 18*a*. It will, of course, be appreciated that additional deblocking switches may be provided if additional unused or deblocking input ports 18*a* are available on the multilevel switch matrix, each such additional deblocking switch necessitating the inclusion of an additional directional coupler connected between each input signal source and its associated input port 18. Deblocking switches 38, 42 and 46 may be embodied in any form, such as solid state or electromechanical switches, adapted for operation in response to suitable output control signals developed by computer 26 and coupled to the switches by one or more conductors generally indicated by dotted line 60.

In operation, assume that the control computer 26 is supplied with user input data representing a desired input port 18 to output port 25 connection. In response thereto, computer 26 will develop suitable signals on bus 28 setting the composite state of the multilevel switching matrix for achieving the desired connection. The computer will then monitor the attempted connection through a bus 62 to determine whether it has been successfully completed or whether a blocked condition results. If the desired connection is successfully completed the computer will take no further action. However, if a blocked condition is detected, the computer will operate one of the deblocking switches for coupling the blocked input signal source to one of the deblocking inputs 18*a* such that the input signal source may be connected to the desired output 25. For example, assume that computer 26 is instructed to connect input signal source 2 to a certain output port 25. The computer will therefore initially attempt to establish a connection between the input port 18 supplied by input signal source 2 and the desired output port 25. If the computer senses that this connection does not achieve the result of coupling input signal source 2 to the desired output port 25, then, for example, switch 38 is operated in response to a control signal on line 60 for coupling the coupled output port of the directional coupler 34*a* supplied by input signal source 2 from an input terminal 36 of switch 38 through output terminal 48 and conductor 50 to a deblocking input port 18*a*. The computer will then appropriately set the composite state of the multilevel switch matrix to interconnect the deblocking input port 18*a* with the desired output port 25 so as to make available the desired input signal source at this output port. Therefore, even though the originally attempted signal path was blocked, the desired input signal source is nevertheless made available at the desired output port 25 by establishing an auxiliary signal path through the operation of the deblocking switch which couples the desired input signal source to a deblocking input port 18*a*.

It will be appreciated that each of the deblocking switches 38, 42 and 46, together with any additional deblocking switches which may be provided, operates in response to computer 26 in a manner identical to that described above. Thus, for example, if one of the deblocking switches is already in use for deblocking a pre-existing blocked connection, a second of the switches may be used upon the detection of a new blocked condition, and so on. Also, a condition may arise wherein an attempted connection between a deblocking input port 18*a* and a desired output port 25 is itself blocked. In this case, it may be desirable to operate a second one of the deblocking switches to couple the desired input signal source to a different deblocking input port 18*a* which can be coupled to the desired output port.

While particular embodiments of the invention have been shown and described, it will be apparent that changes and modifications may be made therein without departing from the invention in its broader aspects. The aim of the appended claims, therefore, is to cover all changes and modifications as fall within the true spirit and scope of the invention.

What is claimed as new and desired to be secured by Letters Patent of the United States is:

1. An add-on system for facilitating connection between an input port and a desired output port in a multilevel antenna switching matrix of the type including a plurality of inputs each supplied by a respective antenna input signal, a selected number of said input ports being unused ports and wherein said matrix further includes a plurality of output ports supplying a signal to a plurality of receivers, the add-on system comprising:

a plurality of switch devices each one of which is selectively operable for coupling a portion of each one of said antenna input signals to a different one of said unused input ports; and control means responsive to the detection of a blocked condition which blocked condition is characterized by an attempted connection between a desired one of said input ports and a desired output port for operating said switching means for coupling the antenna input signal supplying said desired input port to said one of said unused input ports for facilitating the connection thereof to said desired output ports.

2. The system of claim 1 further comprising a directional coupler connected between each of said antenna input signals sources and its associated input port, each of said directional couplers supplying said coupled output portion connected to said switching means.

* * * * *